United States Patent [19]

Curley

[11] 4,406,223

[45] Sep. 27, 1983

[54] PRINT HAMMER RELEASE MECHANISM

[75] Inventor: Charles M. Curley, Danbury, Conn.

[73] Assignee: SCM Corporation, New York, N.Y.

[21] Appl. No.: 311,226

[22] Filed: Oct. 14, 1981

[51] Int. Cl.[3] ..... B41J 9/127

[52] U.S. Cl. ..... 101/93.48; 400/144.2; 400/175

[58] Field of Search ..... 400/144.2, 144.3, 144.4, 400/157.1, 157.2, 157.3, 160, 161, 161.1, 168, 173, 175; 101/93.48, 93.28, 93.33

[56] References Cited

U.S. PATENT DOCUMENTS

| | | | |
|---|---|---|---|
| 3,983,985 | 10/1976 | Guerrini et al. | 400/144.2 |
| 4,037,532 | 7/1977 | Plaza et al. | 101/93.48 |
| 4,299,502 | 11/1981 | Harre | 400/144.2 |
| 4,310,255 | 1/1982 | Asano et al. | 400/144.2 X |
| 4,314,770 | 2/1982 | Harre | 400/144.2 X |
| 4,324,496 | 4/1982 | Link | 400/175 X |
| 4,327,639 | 5/1982 | Crystal et al. | 400/144.2 X |

*Primary Examiner*—Paul T. Sewell
*Assistant Examiner*—David A. Wiecking
*Attorney, Agent, or Firm*—Kenneth W. Greb; Ernest F. Weinberger

[57] ABSTRACT

A print hammer release mechanism for use in typewriters or similar machines in which means are provided for moving the print hammer from a first position in which the print hammer is in position for a printing operation to occur, to a second position which facilitates the insertion of a print element into the typewriter.

2 Claims, 4 Drawing Figures

PRINT HAMMER RELEASE MECHANISM

CROSS-REFERENCES TO RELATED APPLICATIONS

There are no presently pending related applications.

BACKGROUND OF THE INVENTION

1. Field of the Invention

This invention relates to typewriters, printers and like machines, and particularly to a print hammer release mechanism for use in such machines.

2. Description of the Prior Art

The Johnson patent, U.S. Pat. No. 4,124,312, discloses a moving coil hammer mechanism for use in a printer having a print wheel cartridge. In order to remove the print wheel cartridge, the hammer mechanism is manually moved rearwardly causing an over-center spring attached to the hammer mechanism to be moved to an opposite side of the hammer mechanism pivot point. The force generated by the new position of the over-center spring maintains the print hammer mechanism in its rearward position. The print wheel cartridge may then be removed. When a new print wheel cartridge is inserted, the bottom wall of the cartridge causes the hammer mechanism to be pivoted to its forward position.

SUMMARY OF THE INVENTION

The present invention is concerned with a print hammer mechanism wherein the print hammer pivots about a first axis during the printing operation, and pivots about a second axis to facilitate removal and insertion of a print element. A control knob operated by the user actuates a mechanism which pivots the print hammer mechanism about the second axis to facilitate removal and insertion of the print element. After the print element is inserted into the typewriter, the control knob is rotated in the opposite direction and the print hammer is returned to the position for a printing operation to occur.

DESCRIPTION OF THE PREFERRED EMBODIMENT

Figure 1:
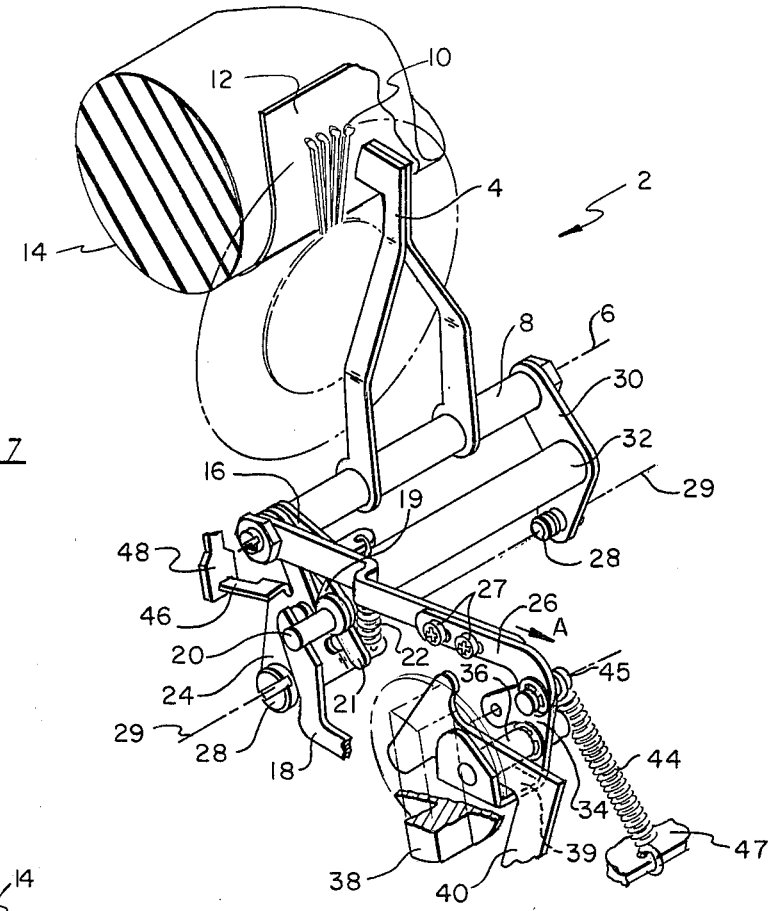
FIG. 1 is a perspective view of the print hammer release mechanism of the present invention.
Figure 4:
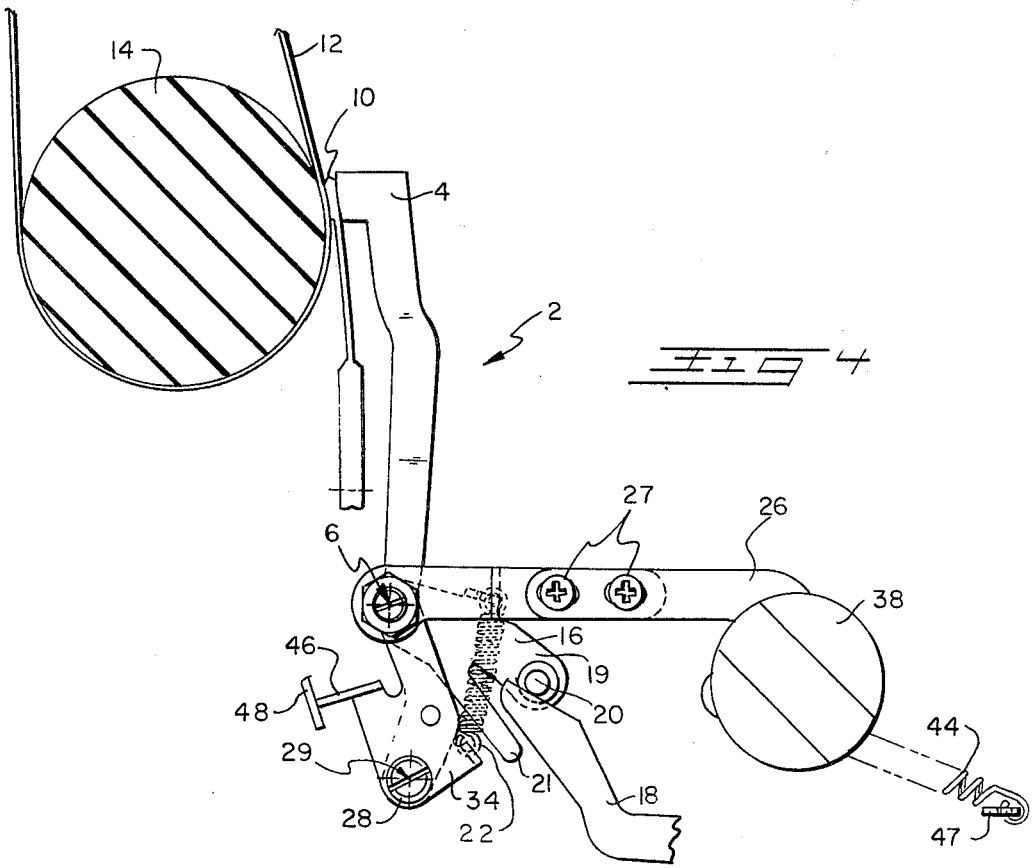

In FIG. 1 there is shown a print hammer assembly 2 which is mounted on a carrier (not shown). The print hammer assembly 2 includes a print hammer 4 which pivots on a rotatable shaft 8 about axis 6 during the printing operation. The printing operation is illustrated in FIG. 4, where it is seen that hammer 4 strikes the back of print element 10 causing the face of print element 10 to form an impression on record medium 12, positioned around platen 14. The impression formed on the record medium 12 corresponds to the configuration on the face of print element 10. The print element 10 may be, for example, the spoke of a rotatable print wheel. In the event the record medium 12 is untreated paper, an ink ribbon (not shown) is fed between the face of the print element and the untreated paper.

The means for rotating shaft 8 counter-clockwise and thereby pivoting print hammer 4 against the back of print element 10, includes a crank member 16 connected to the shaft 8, whereby counter-clockwise rotation of crank member 16 causes counter-clockwise rotation of shaft 8. Crank member 16 includes an opening 17 which enables adjustments to be made to legs 19 and 21 of crank member 16. The means for rotating crank member 16 counter-clockwise includes an arm 18 which moves upwardly against a stud 20 on crank member 16 to rotate crank member 16 counter-clockwise. Stud 20 on crank member 16 is urged into engagement with arm 18 by means of a spring 22 which is connected at one end to crank member 16 and at the other end to a bracket 24. Mechanism (not shown) causes arm 18 to move upwardly in response to the generation of a print signal, as for example, when a signal is generated at a typewriter keyboard or from a remote transmitter.

The means for moving the print hammber 4 away from print element 10 so that a new print element may be inserted includes an adjustable linkage 26 which is connected at one end to rotatable shaft 8. Linkage 26 is adjustable by means of locking screws 27 located in respective grooves in linkage 26. It may be necessary to make such adjustments because of part wear or to compensate for variations in dimensions of manufactured parts. Movement of linkage 26 in the direction of arrow A (see FIG. 1) causes rotatable shaft 8 and thereby print hammer 4 to pivot clockwise about the axis 29 of shaft 28, so that a new print element may be inserted. Rotatable shaft 8 is connected to shaft 28 by means of brackets 24 and 30. Member 32 is connected to brackets 24 and 30 for the purpose of providing stability to the print hammer assembly 2.

The other end of linkage 26 is connected to bracket 34, whereby clockwise rotation of bracket 34 about a shaft 36 of hammer retractor knob 38 moves linkage 26 in the direction of arrow A. As previously noted, movement of linkage 26 in that direction causes print hammer 4 to be pivoted away from print element 10 so that a new type element may be inserted.

Bracket 34 includes a leg 39 which is mounted on the inner surface of hammer retractor knob 38 so that when hammer retractor knob 38 is rotated clockwise it causes leg 39 and thereby bracket 34 to be rotated clockwise about shaft 36 of hammer retractor knob 38. Shaft 36 is supported on a frame 40.

A spring 44 is attached at one end to a stud 45 on bracket 34, and the other end of spring 44 is attached to a stationary support 47. Stationary support 47 may be, for example, a frame for mounting a motor. In the print hammer release mechanism position shown in FIG. 1, spring 44 biases bracket 34 in a counter-clockwise direction.

Figure 3:
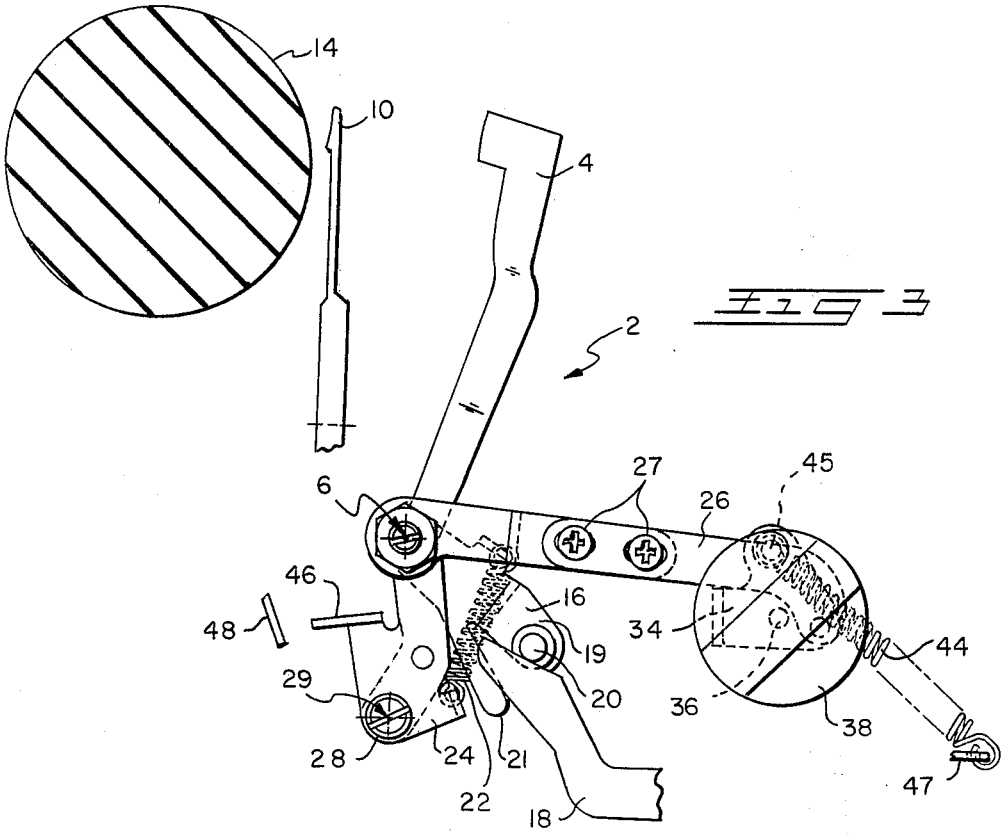
FIG. 3 is a side elevational view of the print hammer release mechanism of the present invention, wherein the print hammer has been pivoted rearwardly to facilitate removal and insertion of the print element; and, FIG. 4 is a side elevational view of the print hammer release mechanism of the present invention, wherein a character is being printed by the print hammer.

When the typist wishes to move the print hammer 4 away from print element 10, so that a new print element may be inserted, the typist rotates hammer retractor knob 38 clockwise. Rotation of hammer retractor knob 38 clockwise rotates bracket 34 clockwise which, as previously mentioned, causes print hammer 4 to be pivoted away from print element 10. When the hammer retractor knob 38 is moved to its most clockwise position as shown in FIG. 3, the force of spring 44 maintains the print hammer in position away from the print element 10.

Figure 2:
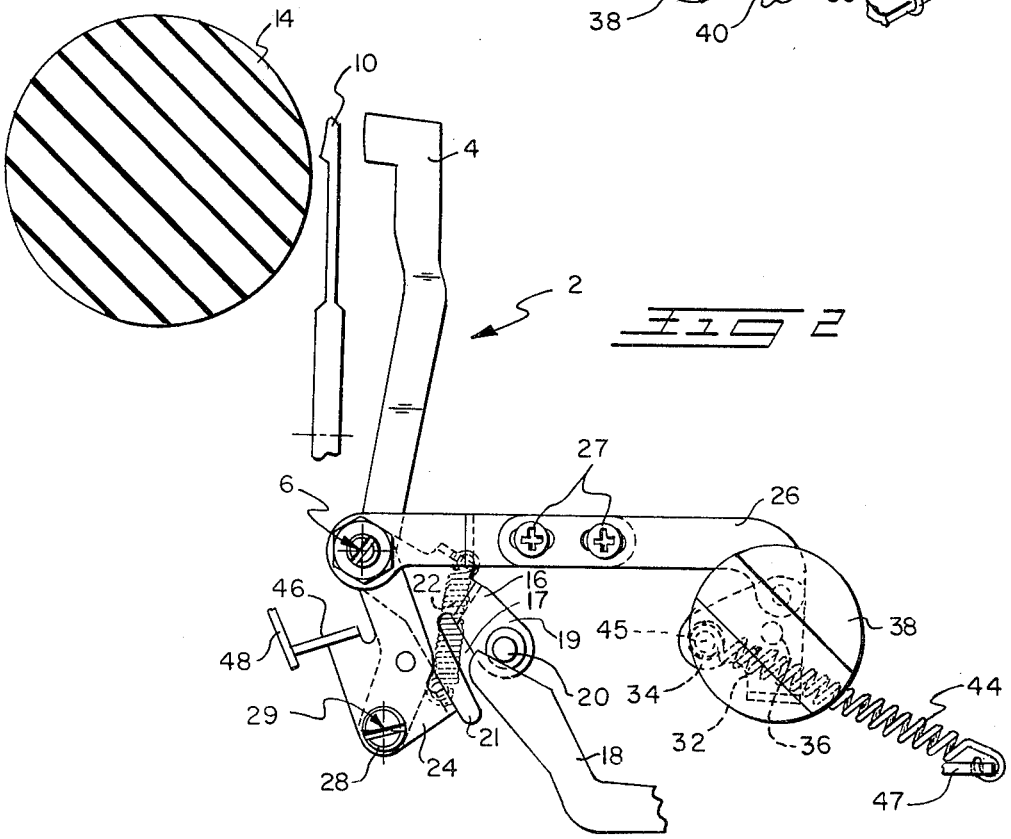
FIG. 2 is a side elevational view of the print hammer release mechanism of the present invention, wherein the print hammer is in position for a printing operation to occur.

After insertion of a new type element, the typist rotates the hammer retractor knob 38 in a counter-clockwise direction which overcomes the force of spring 44 and bracket 34 is rotated counter-clockwise. As bracket 34 is rotated counter-clockwise, linkage 26 moves in the direction opposite to that of the arrow A (i.e. linkage 26 moves toward platen 14). Movement of linkage 26 in this direction causes, by means of structure previously described, the print hammer 4 to be pivoted counter-clockwise into position (see FIG. 2) for a printing operation to occur. In this position, spring 44 maintains the print hammer in position for a printing operation to occur.

The amount that print hammer 4 may be pivoted clockwise is limited by the contact of an ear 46 on bracket 24, with a surface 48 of the print hammer assembly carrier frame. The ear 46 is adjustable by bending for setting the desired spacing between print hammer 4 and printing element 10.

The invention and its attendant advantages will be understood from the foregoing description, and it will be apparent that various changes may be made in the form, construction and arrangements of the parts without departing from the spirit and scope of the invention, the form hereinbefore described being merely a preferred embodiment thereof.

What is claimed is:

1. A print hammer mechanism for use in a typewriter or similar machine having a removable print element and a print hammer operable to impact the print element for printing, the improvement comprising:

a first shaft supporting the print hammer for pivotable movement between a first position and an impact print position for printing operations;

a second shaft;

means pivotably connecting said first shaft to said second shaft for moving the print hammer relative to the print element about said second shaft;

a linkage directly connected to said first shaft for pivoting said first shaft relative to said second shaft for moving the print hammer from said first position to a second position spaced from the print element;

a manual control knob connected to said linkage for moving said linkage to pivot said first shaft relative to said second shaft; and a spring operably connected to said control knob for biasing said control knob in a first orientation for locating the print hammer in said first position and for biasing said control knob in a second orientation for locating the print hammer in said second position for facilitating removing and insertion of the print element relative to the typewriter.

2. A print hammer mechanism as claimed in claim 1 wherein said connecting means is a bracket directly connecting said first shaft to said second shaft.

* * * * *